US006540492B2

(12) United States Patent
Kaido et al.

(10) Patent No.: US 6,540,492 B2
(45) Date of Patent: Apr. 1, 2003

(54) COMPRESSOR PISTON WITH REDUCED DISCHARGE CLEARANCE

(75) Inventors: Peter F. Kaido, Oneida, NY (US); Scott M. MacBain, Syracuse, NY (US); Ronald J. Duppert, Fayetteville, NY (US)

(73) Assignee: Carrier Corporation, Syracuse, NY (US)

( * ) Notice: Subject to any disclaimer, the term of this patent is extended or adjusted under 35 U.S.C. 154(b) by 74 days.

(21) Appl. No.: 09/829,075

(22) Filed: Apr. 9, 2001

(65) Prior Publication Data

US 2002/0146339 A1 Oct. 10, 2002

(51) Int. Cl.[7] ..... F04B 39/10; F04B 53/10

(52) U.S. Cl. ..... 417/562; 417/571; 92/169.1; 92/172

(58) Field of Search ..... 417/562, 571; 92/169.1, 172

(56) References Cited

U.S. PATENT DOCUMENTS 4,027,853 A * 6/1977 Linnert ..... 251/361
4,834,631 A * 5/1989 Schrank et al. ..... 417/283
4,955,796 A * 9/1990 Terwilliger ..... 417/547
4,995,795 A * 2/1991 Hetzel et al. ..... 417/571
5,080,130 A * 1/1992 Terwilliger et al. ..... 137/512
5,203,857 A * 4/1993 Terwilliger et al. ..... 417/552
5,454,397 A * 10/1995 Miszczak ..... 137/512
5,816,783 A * 10/1998 Oshima et al. ..... 417/415

* cited by examiner

*Primary Examiner*—Charles G. Freay
*Assistant Examiner*—William H. Rodriguez
(74) *Attorney, Agent, or Firm*—Carlson, Gaskey & Olds

(57) ABSTRACT

A compressor piston has protrusions which extend upwardly into discharge ports to minimize clearance at the end of the compression stroke. The protrusions fit into circumferentially isolated discharge ports, and each of the ports are associated with reed valves. Preferably a cutout portion is formed into the piston head to allow clearance for movement of the suction valve. The suction valve is positioned on an inner face of a valve plate and the discharge reed valves are positioned on an outer face. The protrusions are preferably frustro-conical.

9 Claims, 2 Drawing Sheets

COMPRESSOR PISTON WITH REDUCED DISCHARGE CLEARANCE

BACKGROUND OF THE INVENTION

This invention relates to a compressor piston wherein projections extend upwardly from an end face of the piston head from plural circumferentially spaced locations, and into a discharge port to reduce clearance volume.

Compressors are utilized to compress gases such as refrigerant. One standard type of compressor is a reciprocating compressor wherein a piston head is driven between a lower position at which a fluid to be compressed enters the compression cylinder, and an upper or "top" position at which the compressed fluid is driven outwardly of the cylinder. A valve plate is typically placed at the top of the cylinder. The term "top" and "bottom" do not refer to any vertical orientation, but instead only to a position in the cylinder. The valve plate carries both inlet and outlet valves for allowing the flow of fluid into the cylinder, and out of the cylinder at appropriate points in the reciprocating movement of the piston.

Various types of valves are known, and various types of valve plates have been utilized. One type of valve plate has a central concentric discharge valve extending around the center of the cylinder. A suction valve is placed at a location further outwardly.

The discharge valve is typically on an outer face of the valve plate, and there is a discharge port volume between the top of the cylinder and the discharge valve through the valve plate. In the prior art it is known to form a concentric ring on the compressor piston to fit upwardly into this volume and to reduce clearance volume.

One other type of compressor valving structure uses reed valves. A reed valve would typically cover a plurality of circumferentially spaced ports. In the past there has been no piston structure to eliminate the clearance space. Instead, the valve plate has been modified in various ways. However, these modifications have for the most part potentially weakened the valve plate, and thus have some drawbacks.

SUMMARY OF THE INVENTION

In the disclosed embodiment of this invention, a piston for a compressor has a plurality of circumferentially spaced protrusions extending above a nominal surface face of the piston. The protrusions fit into circumferentially isolated discharge ports in the valve plate. The discharge ports are associated with reed valves, and the protrusions ensure that the clearance volume is minimized. Minimizing the clearance volume increases the amount of fluid which is compressed during each stroke. In a preferred embodiment the piston has at least two protrusions which are non-concentric and preferably each within the same semi-circle. Further, the piston has a cutout portion extending into the nominal face of the piston for receiving the suction valve. The suction valve is preferably also a reed valve located to cover circumferentially spaced suction ports.

In this manner, the present invention provides a piston for a compressor which minimizes the clearance space in the discharge ports of valve plates utilizing reed valves, which have circumferentially spaced discharge ports. Most preferably the protrusion have frustro-conical outer peripheries to minimize or limit the restriction of gas flow during the final portion of the discharge stroke.

These and other features of the present invention can be best understood from the following specification and drawings, the following of which is a brief description.

DETAILED DESCRIPTION OF A PREFERRED EMBODIMENT

Figure 1:
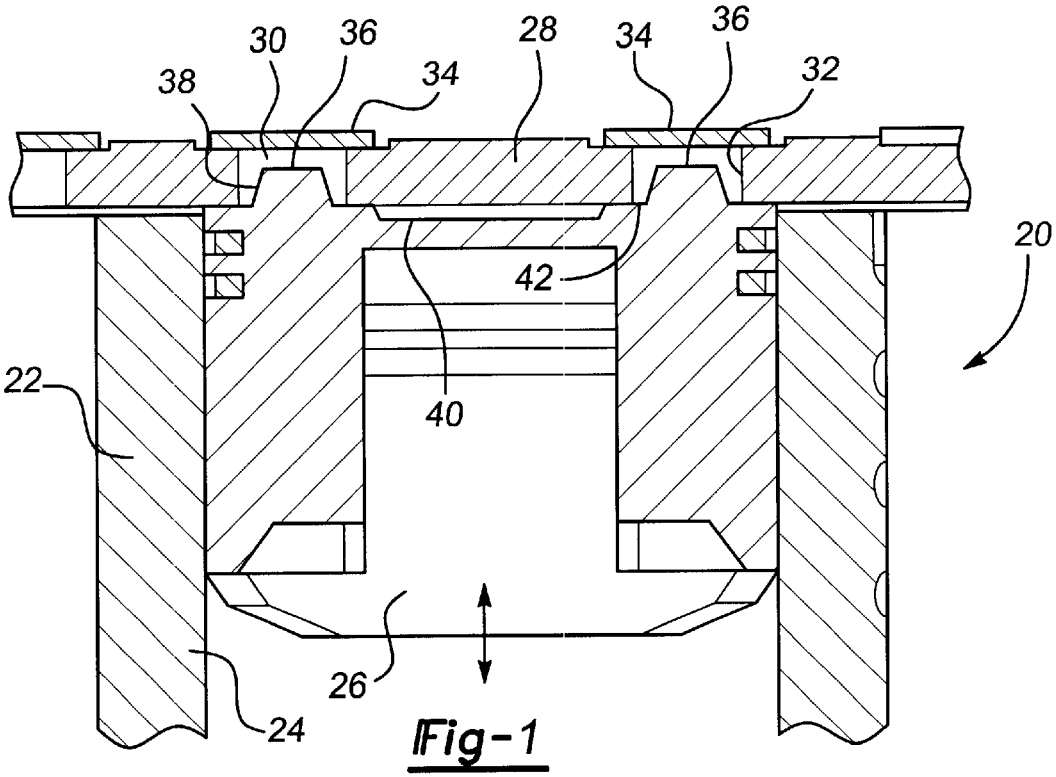
FIG. 1 is a cross-sectional view through a compressor incorporating the present invention.

A piston and cylinder combination 20 is illustrated in FIG. 1 having a cylinder housing 22 receiving a cylinder liner 24. A piston 26 reciprocates within the cylinder liner 24. A valve plate 28 includes circumferentially spaced discharge ports 30 and 32. A reed valve 34 is placed over the ports 30 and 32. Protrusions 36 extend upwardly from a nominal top surface face 42 of the piston. The outer periphery 38 of the protrusions 36 is frustro-conical. A suction valve 39 is formed on an inner face of the valve plate 28 and aligned with a cutout portion 40 within the piston 26.

Figure 2:
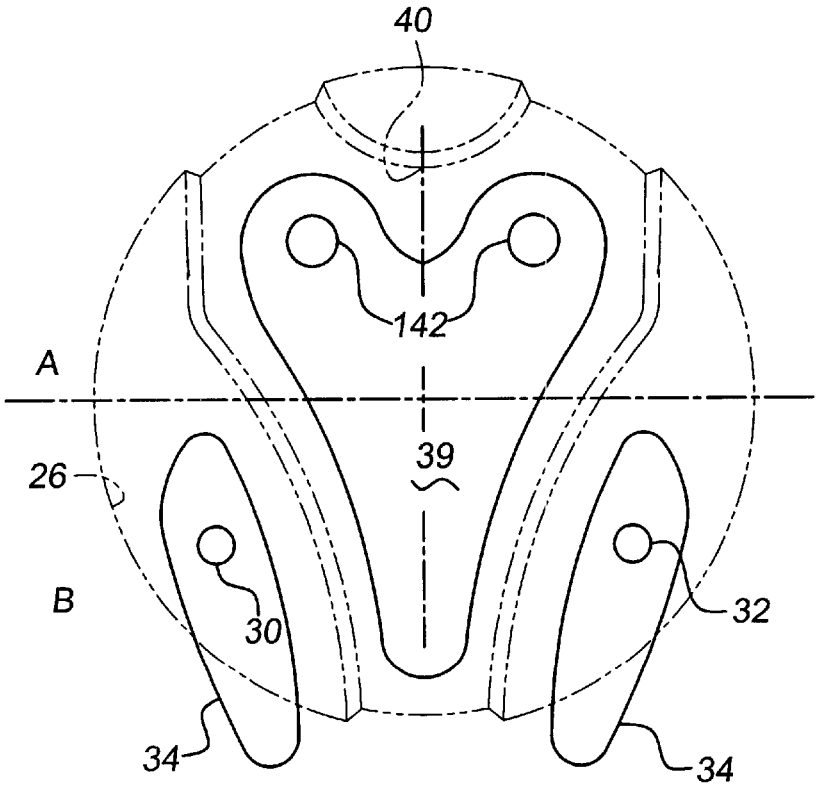
FIG. 2 is a top view of a valve plate.

As shown in FIG. 2, the valve plate 28 incorporates suction ports 142 which are circumferentially spaced and both disposed to be in with one semi-circle of the outline of the piston as shown in phantom at 26. As mentioned, the discharge ports 30 and 32 are also in a semi-circle portion. A suction valve 39 covers ports 42. As can be seen, the size of the valve 39 is smaller than cutout 40.

Figure 3:
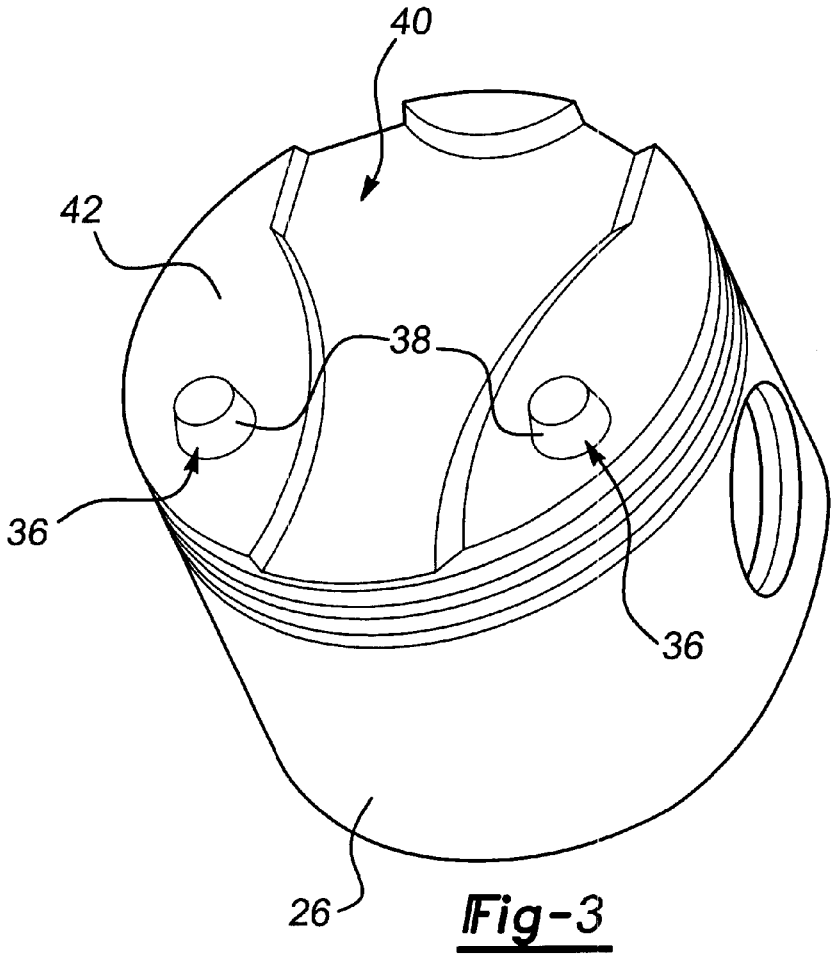
FIG. 3 is a top view of an inventive piston.

As shown in FIG. 3, the protrusions 36 extends upwardly from the nominal top surface 42 and the cutout portion 40 is positioned between the protrusions 36.

Figure 4:
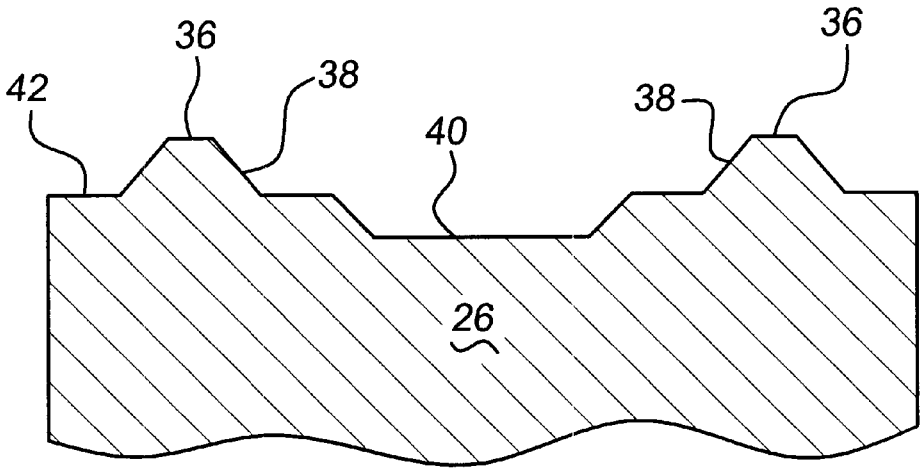
FIG. 4 is a cross-sectional view through the piston.

As shown in FIG. 4, the top surface of the piston 26 includes a pair of protrusions 36 each having frustro-conical outer periphery 38. The nominal top surface 42 and the cutout portion 40 are also shown.

The present invention thus provides a compressor piston which will minimize clearance in compressor discharge ports. The use of the circumferentially spaced plural protrusions provides a modified piston which will minimize clearance in a valve plate utilizing reed valves. Said in another way, the protrusions are non-concentric, and distinct from the prior art.

Although a preferred embodiment of this invention has been disclosed, a worker in this art would recognize that certain modifications would come within the scope of this invention. For that reason the following claims should be studied to determine the true scope and content of this invention.

What is claimed is:

1. A compressor comprising:

a cylinder extending along an axis;

a piston reciprocating along said axis between a bottom portion and a top portion and having an upper face defining a circular piston profile;

a valve plate closing said cylinder at said top, said valve plate having a plurality of circumferentially spaced discharge ports aligned within one semi-circle of said piston profile and a plurality of circumferentially spaced suction ports within an opposed semi-circle, and reed valves closing said discharge ports, said reed valves being mounted on an outer face of said valve plate; and said piston having a top surface including a plurality of circumferentially spaced protrusions with one of said protrusions associated with each of said discharge ports, and said plurality of protrusions being formed to be non-concentric relative to the center of said piston.

2. A compressor as recited in claim 1, wherein a suction valve is positioned on an inner face of said valve plate and covering said suction ports.

3. A compressor as recited in claim 2, wherein said piston has a suction valve cutout portion extending into said piston and aligned with said suction valve to allow movement of said suction valve within said cutout portion.

4. A compressor as recited in claim 1, wherein said protrusions have frustro-conical outer peripheries to minimize flow resistance between said protrusion and said discharge port.

5. A compressor as recited in claim 3, wherein said cutout portion has two generally curved sides and extends across the entire diameter of said piston, with nominal surfaces being formed on each of said sides, and one of said protrusions being positioned within each of said nominal surface areas.

6. A compressor comprising:

a cylinder extending along an axis;

a piston reciprocating along said axis between a bottom portion and a top portion and having an upper face defining a circular piston profile;

a valve plate closing said cylinder at said top, said valve plate having a plurality of circumferentially spaced discharge ports aligned within one semi-circle of said piston profile and a plurality of suction ports within an opposed semi-cylinder, and reed valves closing said discharge ports and said suction ports, said discharge reed valves being mounted on an outer face of said valve plate and said suction reed valve being mounted on an inner face of said valve plate; and said piston having a top surface including a plurality of circumferentially spaced protrusions with one of said protrusions associated with each of said discharge ports, and said plurality of protrusions being formed within one semi-circle of said piston profile.

7. A compressor as recited in claim 6, wherein said piston has a suction valve cutout portion extending into said piston and aligned with said suction valve to allow movement of said suction valve within said cutout portion.

8. A compressor as recited in claim 6, wherein said protrusions have frustro-conical outer peripheries to minimize flow resistance between said protrusion and said discharge port.

9. A compressor as recited in claim 8, wherein said cutout portion has two generally curved sides and extends across the entire diameter of said piston, with nominal surfaces being formed on each of said sides, and one of said protrusions being positioned within each of said nominal surface areas.

* * * * *